US006334807B1

(12) United States Patent
Lebel et al.

(10) Patent No.: US 6,334,807 B1
(45) Date of Patent: Jan. 1, 2002

(54) CHEMICAL MECHANICAL POLISHING IN-SITU END POINT SYSTEM

(75) Inventors: Richard J. Lebel, Williston; Rock Nadeau, Jericho, both of VT (US); Martin P. O'Boyle, Cortlandt Manor, NY (US); Paul H. Smith, Jr., Essex Junction, VT (US); Theodore G. van Kessel, Millbrook; Hemantha K. Wickramasinghe, Chappaqua, both of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/302,737

(22) Filed: Apr. 30, 1999

(51) Int. Cl.[7] ..... B24B 49/00
(52) U.S. Cl. ..... 451/6; 451/5; 451/9; 451/159
(58) Field of Search ..... 451/5, 6, 9, 159

(56) References Cited

U.S. PATENT DOCUMENTS

| | | | | |
|---|---|---|---|---|
| 4,839,311 | A | | 6/1989 | Riley et al. |
| 5,069,002 | A | | 12/1991 | Sandhu et al. |
| 5,081,421 | A | | 1/1992 | Miller et al. |
| 5,196,353 | A | | 3/1993 | Sandhu et al. |
| 5,234,868 | A | | 8/1993 | Cote |
| 5,240,552 | A | | 8/1993 | Yu et al. |
| RE34,425 | E | | 11/1993 | Schultz |
| 5,265,378 | A | | 11/1993 | Rostoker |
| 5,337,015 | A | | 8/1994 | Lustig et al. |
| 5,413,941 | A | | 5/1995 | Koos et al. |
| 5,433,650 | A | | 7/1995 | Winebarger |
| 5,433,651 | A | | 7/1995 | Lustig et al. |
| 5,461,007 | A | | 10/1995 | Kobayashi |
| 5,492,594 | A | | 2/1996 | Burke et al. |
| 5,499,733 | A | | 3/1996 | Litvak |
| 5,640,242 | A | | 6/1997 | O'Boyle et al. |
| 5,733,171 | A | * | 3/1998 | Allen et al. |
| 5,872,633 | A | * | 2/1999 | Helzapfel et al. |
| 5,961,369 | A | * | 10/1999 | Bartels et al. |

OTHER PUBLICATIONS

Semiconductor International, "Implementing Real–Time Endpoint Control in CMP", Litvak et al., Jul. 1996, pp. 259–264.

IBM Technical Disclosure Bulletin, "End–Point Detection of Chemical/Mechanical Polishing of Circuitized Multilayer Substrates", Chou et al., vol. 34, No. 4B, Sep. 1991, pp. 406–407.

CMP–MIC Conference 1997 ISMIC, "CMP Oxide Endpoint Detection: a Simplistic Approach to a Complex Problem", Holzapfel et al., Feb. 13–14, 1997, pp. 44–51.

* cited by examiner

*Primary Examiner*—Timothy V. Eley
*Assistant Examiner*—Willie Berry, Jr.
(74) *Attorney, Agent, or Firm*—McGinn & Gibb, PLLC; Howard J. Walter, Jr. Esq.

(57) ABSTRACT

A structure and method for polishing a device include oscillating a carrier over an abrasive surface (the carrier bringing a polished surface of the device into contact with the abrasive surface, the oscillating allowing a portion of the polished surface to periodically oscillate off the abrasive surface), optically determining a reflective measure of a plurality of locations of the polished surface as the portion of the device oscillates off the abrasive surface and calculating depths of the locations of the polished surface based of the reflective measure.

27 Claims, 3 Drawing Sheets

CHEMICAL MECHANICAL POLISHING IN-SITU END POINT SYSTEM

BACKGROUND OF THE INVENTION

1. Field of the Invention

The present invention generally relates to planarizing systems and more particularly to an improved chemical mechanical polishing system with real-time polishing rate measurement and control.

2. Description of the Related Art

Chemical mechanical polishing/planarization (CMP) is becoming more popular as a choice for planarizing materials in today's advanced integrated circuit devices. More specifically, the increased use of shallow trench isolation (STI) regions makes chemical mechanical polishing a more commonly used process.

Basically, in a chemical mechanical polishing process a surface of an item, such as a wafer, is made planar (e.g., substantially flat) by holding the wafer (e.g., using a rotating carrier) against a rotating polishing table that contains an abrasive slurry. Material is removed to render the exposed surface planar. The rate that the material is removed from the wafer depends upon the pressure applied between the carrier and the polishing table pads, temperature, polishing time and type of slurry utilized. If too much material is removed the item being polished may have to be scrapped. If too little material is removed, the item will not be properly planarized and must be reworked/repolished.

Conventional CMP control strategies and practices require extensive "send ahead" measurements to remove the right amount of material. In other words, conventional systems determine the correct polishing time, pressure and slurry makeup by performing experiments on various test batches of wafers. Once the correct recipe of time, pressure and slurry is determined, it is applied to production wafers. Also, "send ahead" production wafers are periodically sampled after being polished to evaluate the polishing process. The polishing process is then adjusted accordingly. For example, if the wafers are under-polished the polishing time, pressure or temperature may be increased. If the wafers are overpolished, they may be scrapped and the polishing time, pressure and temperature may be decreased.

However, such conventional systems often destroy large numbers of wafers because an under-polishing or over-polishing situation cannot be detected until after it has occurred (e.g., silent failures), at which point many defective wafers which were made before the silent failure was detected may have to be scrapped or reworked. Therefore, there is a need for a polishing system which measures the polishing rate in real-time and eliminates or reduces the amount of scrap associated with "send ahead" measurement techniques.

SUMMARY OF THE INVENTION

It is, therefore, an object of the present invention to provide a structure and method for polishing a device that includes oscillating a carrier over an abrasive surface (the carrier bringing a polished surface of the device into contact with the abrasive surface, the oscillating allowing a portion of the polished surface to periodically oscillate off the abrasive surface), optically determining a reflective measure of a plurality of locations of the polished surface as the portion of the device oscillates off the abrasive surface and calculating depths of the locations of the polished surface based of the reflective measurement.

The invention may also include calculating a rate of material removal based on the depths of the locations of the polished surface, calculating a change of material composition of the polished surface based on a change in the reflective quality, and/or calculating a thickness of a layer of the polished surface based on the depths of the locations of the polished surface.

The invention also includes rinsing the polished surface as the carrier oscillates off the abrasive surface. The calculating of the depths preferably determines a smallest of the depths. The invention may also remove a pattern of the light source from the reflective measure to accommodate for background characteristics.

Therefore, the invention provides a system and method for measuring the thickness of a material being polished in real time using optical measuring techniques. The invention includes a water jacket which removes any abrasive material and increases the accuracy of the optical measurement. Further, the invention avoids the problem of spectral smearing by utilizing a high-speed strobe during the optical analysis of the surface be polished.

In addition, the invention measures the thickness of many points on the surface being polished to increase the thickness measurement accuracy. Further, the invention provides a very accurate endpoint detection system (for transparent and non-transparent materials) by observing the optical index change.

Therefore, the invention overcomes the production loss and excessive scrap associated with conventional send ahead measurement techniques.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENTS OF THE INVENTION

The invention uses optics to achieve an endpoint signal that eliminates the need for send-ahead measurements. Thus, the invention is capable of screening catastrophic failure conditions to eliminate silent failures that would otherwise cause large scale product scrap conditions. The invention can be used with any polishing system (e.g., a chemical mechanical polishing (CMP) system), such as systems for removing transparent films or systems for removing non-transparent films. The invention is not limited to polishing any specific type of device but instead is applicable to polishing or planarizing any surface. Therefore, for example, the invention could be utilized to polish any material to a given thickness, such as optical devices, glasses, metals, integrated circuit wafers or any surface with one or more semi-transparent films.

Figure 1:
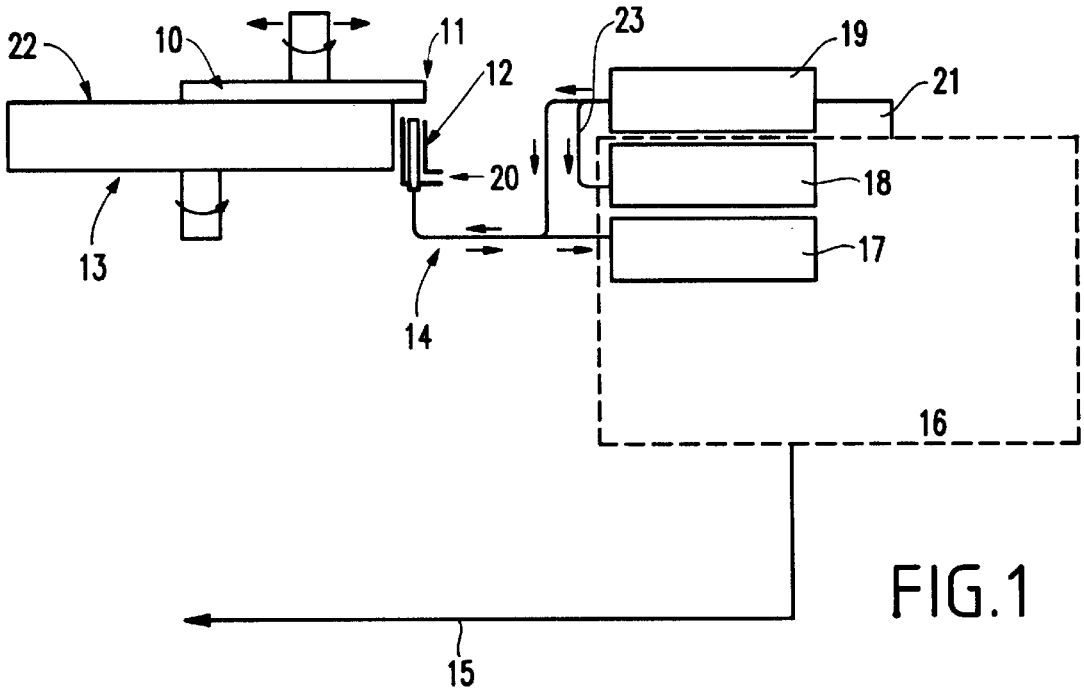
FIG. 1 is a schematic diagram of a pulsed optical endpoint system according to the invention.

FIG. 1 illustrates a preferred embodiment of the invention. The invention includes means for polishing which applies an abrasive to an item being polished. The polishing means can be any well known structure such as a belt polisher, rotating platen polisher, etc. For example, as shown in FIG. 1, a rotating polishing platen 13 maintains an abrasive slurry 22. The item being polished (which has a polished surface) 10 is connected to an oscillating rotating carrier 11 which causes the item being polished 10 to come in contact with the slurry 22.

The invention also includes means for optically determining a reflective measure of the polished surface. Such optical determining means could include for example, means for generating light 19, means for transmitting light 14 to and from the polished surface 10 and means for calculating the depth of the polished surface 16. The means for generating light 19 could be any light source and is preferably a TTL triggered xenon strobe light source. Other light sources which can be used with the invention include tungsten halogen, tungsten, light emitting diodes (LED) flourescent lights, etc. In a preferred embodiment, the light source is controlled using, for example, a strobe controller, electronic shuttering or mechanical shuttering.

The light transmitting means 14 transmits the light to and from the surface being polished and could comprise one or more single optical fibers, one or more optical fiber bundles, a split optical fiber bundle, an arrangement of mirrors, a liquid light pipe, etc. Alternatively, the light source 19 could be positioned such that it aims light directly at the surface being polished, thus eliminating or reducing the need for a light transmitting means.

Motion of the device being polished 10 may cause spectral smearing (due to pattern non-uniformity) during the normal integration time of a spectrometer. Therefore, in a preferred embodiment, a strobed light source with a pulse period on the order of 10 microseconds is utilized to avoid spectral smearing.

In a preferred embodiment, the light transmitting means 14 is positioned within or arranged adjacent means for rinsing the polished surface 12 (e.g., a liquid carrying jacket, a hose, etc.). The probe 12,14 is mounted in a position to simultaneously supply a rinsing agent (e.g., water) and light to the surface of the item being polished 10 as the carrier 11 oscillates off the polishing platen 13. Slurry becomes opaque beyond a thickness of approximately 0.5 mm. The invention overcomes this problem by rinsing the surface being polished 10 while observing the reflective quality. Thus, with the invention, the interface between the spinning device being polished 10 and the optical sensing device 14 is always free from opaque slurry.

In a preferred embodiment a portion (e.g., the outer fibers) of a split optical fiber bundle 14 transmits light to the surface of the item being polished 10 and another portion (e.g., the inner fibers) of the split optical fiber bundle 14 receives a reflection of light from the surface being polished 10.

It is undesirable to stop the polishing and move the carrier (as is done conventionally) to measure the polishing rate because this slows production and increases the likelihood of uneven polishing. The invention overcomes this problem by oscillating the radial position of the carrier 11 such that only the edge of the item being polished 10 protrudes off the edge of the platen 13. For example, approximately 1 inch of the item being polished 10 may periodically be exposed during normal carrier 11 rotation/oscillation (e.g., at approximately 0.3 Hz). Thus, the invention continues to polish and to maintain downforce and backpressure on the wafer while the polishing rate is being measured. By choosing oscillation periods of about 5 seconds, sample windows are achieved frequently to produce good real time removal estimates.

The light source 19 may, for example, produce a strobe 21 illuminated at approximately 10 Hz. The reflected light from the item being polished 10 is directed using the same light transmitting means 14 discussed above or another similar light transmitting means. As discussed above, in a preferred embodiment, the inner fibers of the split optical fiber bundle 14 return the reflected light to a calculating means 16. The calculating means 16 can be a computer or other similar device having a memory, central processing unit, display device, input device, etc. The calculating means 16 controls the light source 19 (through connection 21) and also can include light analyzing means 17, 18 such as a spectrometer (e.g., a single board spectrometer), liquid crystal display (LCD) variable filter, discrete filters/detractors, etc.

Conventional patterned product wafers have large variations in both underlying films and structure. However, the surfaces are uniform down to the order of a millimeter in most cases. Therefore, in a preferred embodiment, the light detecting means 14 is placed in direct proximity of the wafer to achieve a spot size on the order of 1 millimeter.

The computer may also include a second light analyzer 18 (which could be similar or different than the light analyzing means 17) which is connected to the light source 19 by the light transmitting means 14. In a preferred example, a single board spectrometer 17 produces a light spectrum (e.g., from 300–600 nm) for each pulse of the light source 19 reflected from the surface being polished 10.

The output from light sources can vary with time. Therefore, background measurements need to be made in order to achieve accurate reflectance spectra. The invention solves this problem by feeding back the light from the source 19 (e.g., via a split fiber or other similar feedback device 23) directly from the light source 19 to the second spectrometer 18. Thus, with the invention, the computer simultaneously acquires the raw reflectance spectrum from the sample 10 and the background spectrum from the source 19 which allows the invention to be self-calibrating and eliminates the need to perform calibrations on the factory floor. By feeding the strobe light source 19 back to the second light analyzer 18, accurate pulse to pulse background removal is provided. This eliminates the need to perform background measurements and improves pulse to pulse spectrum uniformity.

Thus, the invention acquires the light spectra as the item being polished 10 passes over the probe 12, 14. These light spectra are measured by the analyzer 17 according to the amplitude of reflected light. Thus, the invention measures more than a single area of the item being polish. Instead, the invention measures a number of different points on the item being polished to improve measurement accuracy.

In a preferred embodiment, a cluster of light spectra (e.g, 100 different locations on the surface being polished) are acquired each time the carrier 11 oscillates off the platen 13. As discussed above, the item being polished moves from being completely on the platen 13 to being at a maximum distance off the platen 13. This allows the probe 12, 14 to view many points of the item being polished 10.

Conventional polish uniformity is very poor at the outer 5 mm of the item being polished 10. The invention resolves this problem by oscillating the wafer and only sampling those points that are beyond a minimum radial distance of the item being polished 10. Thus, with the invention, the light spectra from the beginning and end of the cluster are preferably excluded to insure that the remaining light spectra represent the radial positions on the polished surface 10 and not the edges of the polished surface 10. Using a semiconductor wafer as an example, if the total polish time for a wafer is approximately 4 minutes, the clusters of light spectra are preferably acquired approximately every 2 seconds. Sampling and polishing are separate events, and the sampling must be completed in time to estimate the wafer polish rate before any over-polishing occurs.

Figure 2:
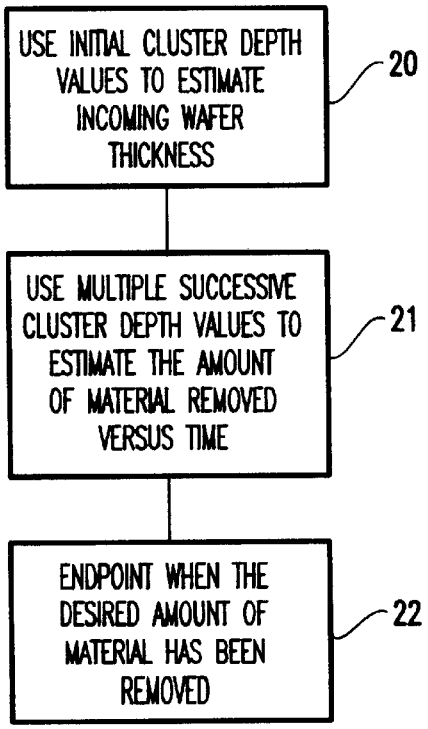
FIG. 2 is a flow diagram illustrating a preferred method of the invention.

Clusters are analyzed as shown in FIG. 2. Initial cluster depth values are used to estimate the initial thickness of a transparent or semi-transparent surface of the item being polished 10, as shown in item 20. Multiple successive cluster depth values indicate the amount of material removed versus time, thus providing a very accurate material removal rate, as shown in item 21. Finally, the endpoint of the polishing is reached when the desired amount of material is removed as shown in item 22. More specifically, the removal rate, calculated above, is multiplied by the polishing time to determine the amount of material removed.

Figure 3:
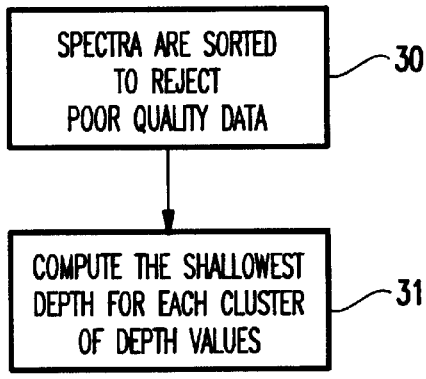
FIG. 3 is a flow diagram illustrating a preferred method of the invention.

For each of the clusters mentioned above, the cluster depth values are determined as shown in FIG. 3. In item 30 light spectra are sorted to reject data of poor quality in terms of minimum signal amplitude and spectral purity using signal magnitude and Fourier techniques including FET, all poles analysis, power spectrum estimation, etc.

For each cluster of depth values (e.g., each time the item being polished 10 passes over the probe 12, 14) the shallowest depth is preferably found (after removing the reject data, as mentioned above), as shown in item 31. Each cluster of depths constitutes a large sampling of depths at approximately the same time.

Figure 4:
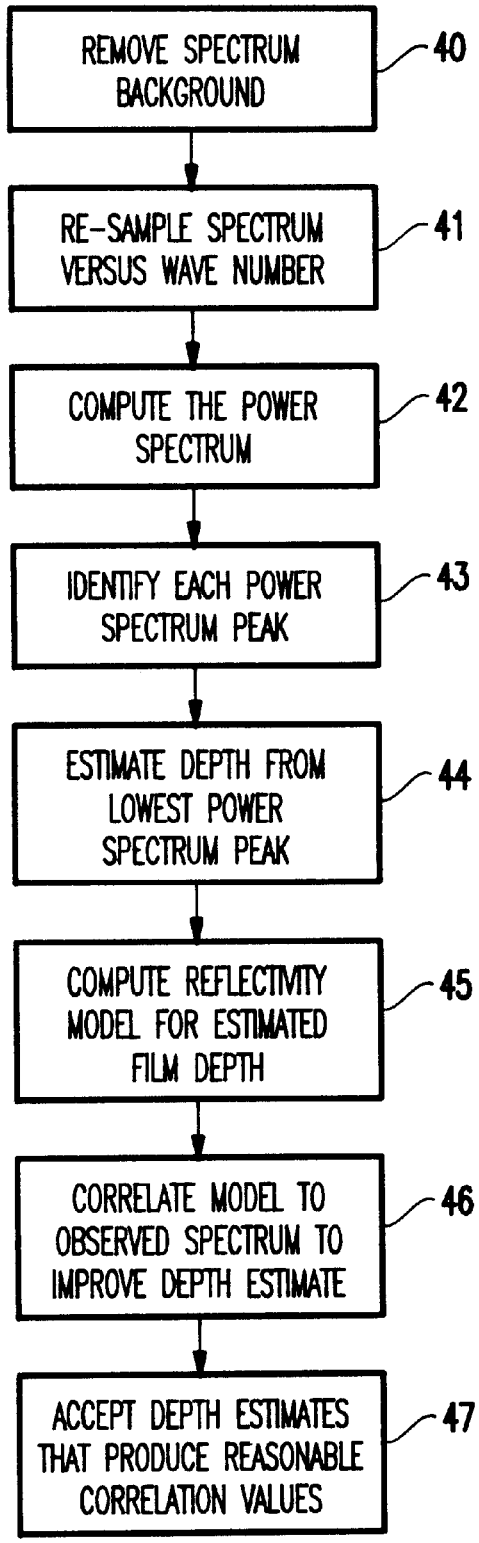
FIG. 4 is a flow diagram illustrating a preferred method of the invention.

Each of the individual light spectrum relating to a single location on the surface being polished 10 (which make up a cluster) is analyzed as shown in FIG. 4. In item 40, the light spectrum background is removed by feeding the light source 19 back to the second light analyzer 18, as discussed above. Then, in item 41 each spectrum is re-sampled versus wave number for accuracy. The wave number is the weighted reciprocal of wave length i.e. if $\lambda$=wavelength in micron then $WN=1/\lambda$.

The power spectrum for each light spectrum is then computed using any conventional method, such as the well-known "all poles" method, as shown in item 42.

Thus, the light waves reflected from the polished surface are compared with the light waves reflected from the next optical barrier (e.g., next material having a different optical index) within the device being polished (e.g., the layer below the layer been polished). The difference between the two reflections is calculated as the thickness of that location of the layer being polished.

The layer being polished may cover many three-dimensional structures of the underlying layer(s). Therefore, the depth of the transparent or semi-transparent layer being polished will vary dramatically depending upon the size and shape of the three-dimensional structures in the underlying layer. As the layer being polished 10 is measured at different locations, dramatically different thicknesses will be observed because of the topography of the underlying layer.

In a preferred embodiment, the invention concentrates of the shallowest thickness of the layer being polished 10. By measuring the shallowest thickness (e.g., smallest depth) the invention removes the layer be polished but allows the tallest structure of the underlying layer to remain unaltered. In such a situation, the smaller underlying structures would be covered by a thicker layer of the transparent or semi-transparent material than that covering the tallest structure.

In item 43, the peak of each power spectrum for each location on the item being polished 10 is determined. In item 44, the power spectrum having a desired value (e.g., lowest, highest, median, average etc.) is selected to represent the material thickness in each cluster. As discussed above (e.g., item 31), in a preferred embodiment, the lowest power spectrum (representing the shallowest location of the surface being polished) is selected to represent the thickness of a given cluster.

A model of reflectively is computed to estimated film depth of the lowest power spectrum peak in item 45. For example, the thin film reflectivity model could be based on any well known modeling technique, such at the optical theory of film stacks modeling technique. The model may deviate from the power spectrum values because of the topography of the underlying layer. Therefore, the model is correlated to the observed spectrum to improve the depth estimate as shown in item 46. Finally, in item 47, depth estimates that produce reasonable correlation values and have correlation depths that are consistent with estimated depths are accepted as valid.

Figure 5:
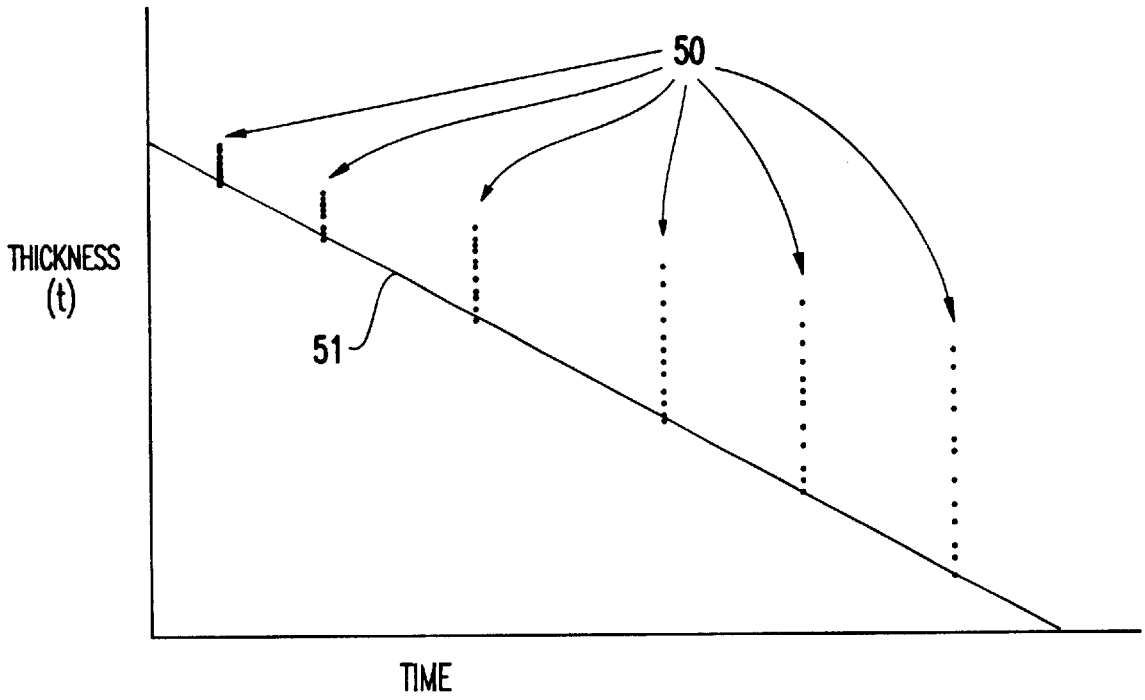
FIG. 5 is a graph illustrating the results of the invention.

FIG. 5 shows measured depths vs. time for many clusters. The distinct bars 50 result form the rapid sampling of multiple locations at discreet times. The shallowest point of each of the bars 50 is plotted along line 51 and represents the minimum thickness of the layer being polished 10. As mentioned above, because of the topography of the underlying layer, the clusters will include different thickness measurements. These thickness measurements will diverge and produce a broader cluster of measurements over time as the topography of the underlying layer produces relatively greater thickness differences in the layer being polished.

Therefore, as shown above, in one embodiment the invention determines the correct removal of a specific thickness of transparent film stack (e.g., oxide polish) by comparing measurements of the film thickness taken during the polish at random locations on the periphery of the wafer versus time to obtain a range of film thickness values. The observed range of thickness values shifts in direct proportion to the amount of material that is removed. This shift provides an exact estimate of the amount of material removed during a given time period, thereby providing a very accurate "real-time" material removal rate. The polishing time can then be controlled to remove the exact amount of material desired.

Similarly, in another embodiment, with respect to detecting the removal of a non-transparent material over a material with different optical characteristics (e.g., polysilicon and tungsten polish), the reflectance spectrum of the wafer is observed. As the non-transparent material (e.g., one having a different optical index) clears from the base material, the reflectance properties change dramatically. This change is detected and used as an endpoint to indicate that one layer is completely polished. Alternatively, the invention can be used to identify the endpoint as the "zero film thickness" point since the thickness of the film is being constantly monitored as discussed above.

Further, one ordinarily skilled in the art would be able to use the invention with non-transparent materials overlying transparent materials. In such a situation, the underlying transparent material will show up as a non-zero thickness when the non-transparent material is completely polished away, thereby indicating the endpoint of polishing the non-transparent material.

Therefore, the invention provides a system and method for measuring the thickness of a material being polished in real time using optical measuring techniques. The invention includes a water jacket which removes any abrasive material and increases the accuracy of the optical measurement. Further, the invention avoids the problem of spectral smearing by utilizing a high-speed strobe during the optical analysis of the surface be polished.

In addition, the invention measures the thickness of many points on the surface being polished to increase the thickness measurement accuracy. Also, the invention provides a very accurate endpoint detection system (for transparent and non-transparent materials) by observing the optical index change. Another benefit which flow from the invention is increased product uniformity. Therefore, the invention overcomes the production loss and excessive scrap associated with conventional send ahead measurement techniques.

While the invention has been described in terms of preferred embodiments, those skilled in the art will recognize that the invention can be practiced with modification within the spirit and scope of the appended claims.

What is claimed is:

1. A method of monitoring the polishing of thin films comprising:

periodically monitoring a reflected optical spectrum from random locations of a polished face of a workpiece to produce monitored data, recording said monitored data;

analyzing said monitored data to determine differences between separate monitored data points of said monitored data; and stopping said polishing when a depth of one of said monitored data points is below a predetermined criterion.

2. The method in claim 1, wherein said predetermined criterion comprises a depth of one of said thin films.

3. The method in claim 1, wherein said monitoring is performed while said workpiece is being polished.

4. The method in claim 1, further comprising calculating a rate of material removal based on said monitored data.

5. The method in claim 1, further comprising calculating a change of material layers based on a change in said monitored data.

6. The method in claim 1, further comprising calculating a thickness of one of said thin films based on said monitored data.

7. The method in claim 1, wherein said periodically monitoring comprises optically measuring reflected light from said polished face as said workpiece oscillates off a polishing surface.

8. The method in claim 1, further comprising rinsing said polished face as said workpiece oscillates off said polishing surface.

9. The method in claim 1, wherein said analyzing said monitored data includes determining which of said monitored data points has a smallest depth representing a smallest thickness point of one of said thin films on said polished surface.

10. A method of polishing a device comprising:

oscillating a carrier over an abrasive surface, said carrier bringing a polished surface of said device into contact with said abrasive surface, said oscillating allowing a portion of said polished surface to periodically oscillate off said abrasive surface;

optically determining a reflective measure of a plurality of random locations of said polished surface as said portion of said device oscillates off said abrasive surface;

calculating depths of said locations of said polished surface based on said reflective measure, wherein said optically determining includes supplying a light source and said calculating includes removing a pattern of said light source from said reflective measure; and stopping said polishing when a depth of one of said locations is below a predetermined criterion.

11. The method as in claim 10, further comprising calculating a rate of material removal based on said depths of said locations of said polished surface.

12. The method in claim 10, further comprising calculating a change of material composition of said polished surface based on a change in said reflective measure.

13. The method in claim 10, further comprising calculating a thickness of a layer of said polished surface based on said depths of said locations of said polished surface.

14. The method in claim 10, further comprising rinsing said polished surface as said carrier oscillates off said abrasive surface.

15. The method in claim 10, wherein said calculating of said depths includes determining a smallest depth of said depths.

16. An apparatus for polishing a device having a polished surface, said apparatus comprising:

an abrasive surface;

a carrier bringing said polished surface into contact with said abrasive surface, said carrier oscillating such that portions of said polished surface periodically oscillate off said abrasive surface;

an optical probe for determining a reflective measure of a plurality of random locations of said polished surface as said portions of said polished surface oscillate off said abrasive surface; and a computer for calculating a depth of said polished surface based on said reflective measure, wherein said computer stops said polishing when a depth of one of said locations is below a predetermined criterion.

17. The apparatus as in claim 16, wherein said computer calculates a rate of material removal based on said depth of said polished surface.

18. The apparatus in claim 16, wherein said computer calculates a change of material composition of said polished surface based on a change in said reflective measure.

19. The apparatus in claim 16, wherein said computer calculates a thickness of a layer of said polished surface based on said depth of said polished surface.

20. The apparatus in claim 16, further comprising a water jacket incorporated adjacent said optical probe for rinsing said polished surface as said carrier oscillates off said abrasive surface.

21. The apparatus in claim 16, wherein said computer determines a smallest depth of said polished surface.

22. An apparatus for polishing a device comprising:

means for polishing a polished surface of said device against an abrasive surface, said polishing means allowing a portion of said polished surface to periodically oscillate off said abrasive surface;

means for optically determining a reflective measure of a plurality of random locations of said polished surface as said portion of said polished surface oscillates off said abrasive surface; means for calculating a depth of said locations of said polished surface based of said reflective measure; and means for stopping said polishing when a depth of one of said locations is below a predetermined criterion.

23. The apparatus as in claim 22, wherein said calculating means calculates a rate of material removal based on said depth of said polished surface.

24. The apparatus in claim 22, wherein said calculating means calculates a change of material composition of said polished surface based on a change in said reflective measure.

25. The apparatus in claim 22, wherein said calculating means calculates a thickness of a layer of said polished surface based on s aid depth of said polished surface.

26. The apparatus in claim 22, further comprising means for rinsing said polished surface as said polished surface oscillates off said abrasive surface.

27. The apparatus in claim 22, wherein said calculating means determines a smallest depth of said polished surface.

* * * * *

UNITED STATES PATENT AND TRADEMARK OFFICE

CERTIFICATE OF CORRECTION

PATENT NO. : 6,334,807 B1 
DATED : January 1, 2002
INVENTOR(S) : Lebel et al.

It is certified that error appears in the above-identified patent and that said Letters Patent is hereby corrected as shown below:

Column 7,
Line 26, after "data" insert -- , wherein said periodically monitoring includes supplying a light source and said analyzing said monitored data includes removing a pattern of said light source from said monitored data; --.

Column 8,
Line 33, after "measure" insert -- wherein said optical probe includes a light source and said computer removes a pattern of said light source from said reflective measure, --.
Line 62, after "measure" insert -- , wherein said optical determining means includes a light source and said calculating means removes a pattern of said light source from said reflective measure --.

Signed and Sealed this

Sixth Day of August, 2002

*Attest:*

*Attesting Officer*

JAMES E. ROGAN
*Director of the United States Patent and Trademark Office*